US006030008A

United States Patent [19]

Chang

[11] Patent Number: 6,030,008

[45] Date of Patent: Feb. 29, 2000

[54] ADJUSTABLE LOCK LATCH

[76] Inventor: Po Han Chang, 20, Nan Kang San Road, Nan Tou, Taiwan

[21] Appl. No.: 08/957,707

[22] Filed: Oct. 24, 1997

[51] Int. Cl.[7] ..... E05C 1/00

[52] U.S. Cl. ..... 292/1.5; 292/169; 292/DIG. 60

[58] Field of Search ..... 292/1.5, 337, 169, 292/169.21, 169.23, 169.14, DIG. 60

[56] References Cited

U.S. PATENT DOCUMENTS

| | | | |
|---|---|---|---|
| 4,602,490 | 7/1986 | Glass et al. | 70/134 |
| 4,725,086 | 2/1988 | Shen | 292/337 |
| 4,759,576 | 7/1988 | Ching | 292/337 |
| 4,840,412 | 6/1989 | Shen | 292/337 |
| 4,890,871 | 1/1990 | Lin | 292/337 |
| 4,902,057 | 2/1990 | Ching | 292/337 |
| 4,950,008 | 8/1990 | Fang | 292/337 |
| 5,020,837 | 6/1991 | Lin | 292/169.13 |
| 5,074,605 | 12/1991 | Fann et al. | 292/337 |
| 5,102,175 | 4/1992 | Wu et al. | 292/337 |
| 5,152,558 | 10/1992 | Smith et al. | 292/1.5 |
| 5,257,838 | 11/1993 | Lin | 292/1.5 |
| 5,354,109 | 10/1994 | Lin | 292/1.5 |
| 5,490,695 | 2/1996 | Shiue | 292/1.5 |
| 5,551,736 | 9/1996 | Fann et al. | 292/1.5 |
| 5,743,573 | 4/1998 | Huang | 292/1.5 |

*Primary Examiner*—Darnell M. Boucher
*Assistant Examiner*—Clifford B Vaterlaus
*Attorney, Agent, or Firm*—Rabin & Champagne, P.C.

[57] ABSTRACT

An adjustable lock latch is composed of a main body, two fastening plates, two rotary wheels, and a handle. The main body has two action rods provided with a projection. The fastening plates are provided with a first position confining hole and a second position confining hole. The rotary wheels are provided with a through hole and a moving block engageable with the projection of the action rods of the main body. The handle is engageable with the through hole of the rotary wheels and with the first position confining hole or the second position confining hole of the fastening plates, so as to actuate the moving block of the rotary wheels.

2 Claims, 2 Drawing Sheets

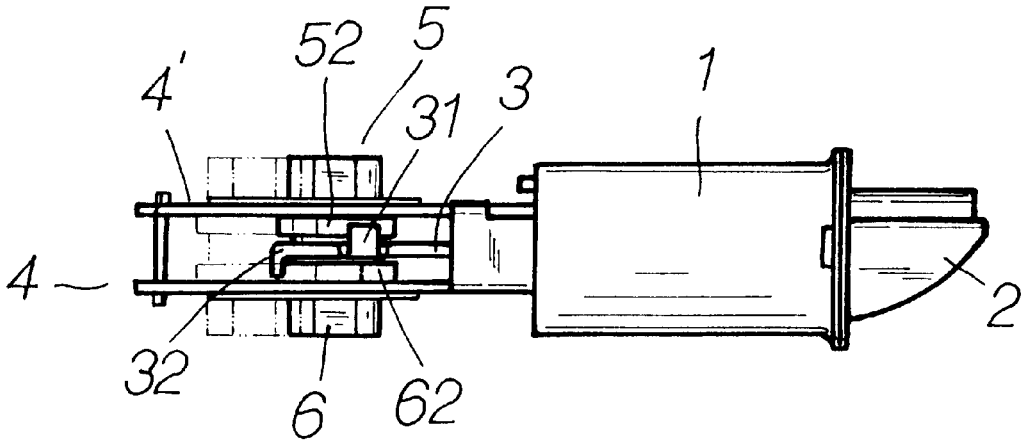
FIG. 2-A
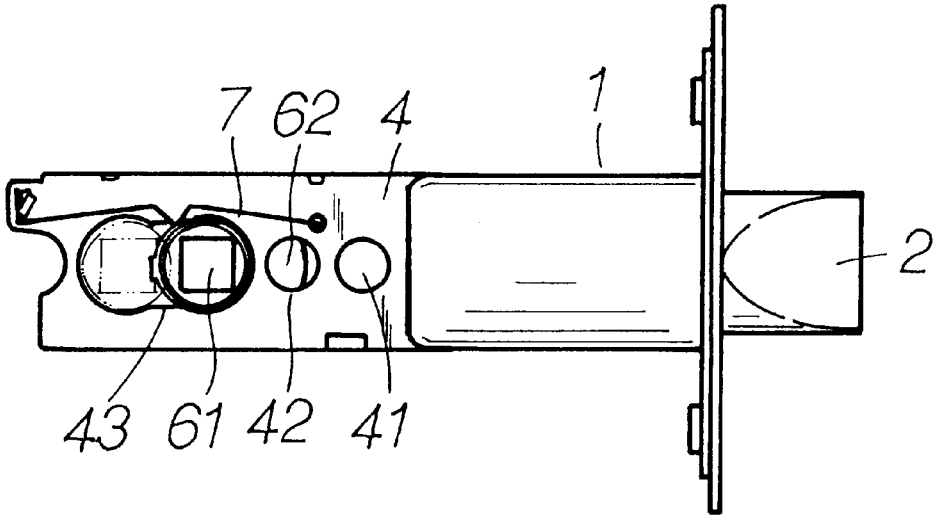
FIG. 2-B

ADJUSTABLE LOCK LATCH

FIELD OF THE INVENTION

The present invention relates generally to a lock, and more particularly to a lock latch.

BACKGROUND OF THE INVENTION

In order to enhance the security of an office or home, the door of the office or home is generally provided with an auxiliary lock, which is installed in a preformed slot in the door. However, it is often difficult to find an auxiliary lock which is designed to fit the preformed slot in the door. As a result, a new slot must be formed in the door to accommodate the auxiliary lock. The formation of the new slot in the door can cost additional money and undermine the structural integrity and the esthetic effect of the door.

SUMMARY OF THE INVENTION

The primary objective of the present invention is therefore to provide an adjustable lock latch capable of eliminating the problem described above.

In keeping with the principle of the present invention, the foregoing objective of the present invention is attained by an adjustable lock latch, which consists of a main body, two fastening plates, and two rotary wheels. The main body comprises a lock tongue and two action rods engaged with the rotary wheels, wherein the rotary wheels are engageable with a handle and capable of horizontal displacement.

The foregoing objective, features, and functions of the present invention will be more readily understood upon a thoughtful deliberation of the following detailed description of an embodiment of the present invention with reference to the accompanying drawings.

BRIEF DESCRIPTION OF THE DRAWINGS

FIG. 2A shows a top view of the present invention.

FIG. 2B shows a side view of the present invention.

DETAILED DESCRIPTION OF THE EMBODIMENT

Figure 1:
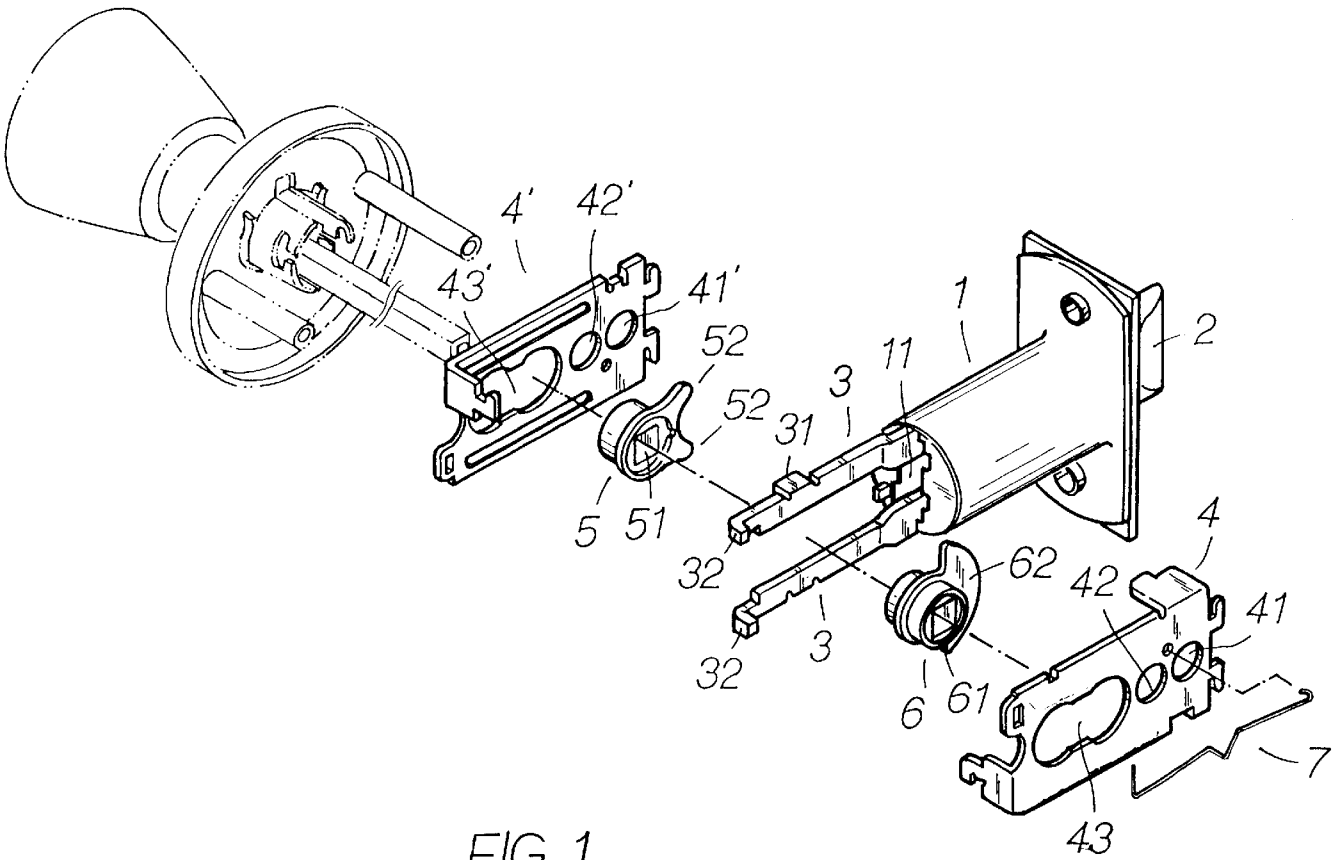
FIG. 1 shows an exploded view of the present invention.

As shown in all drawings provided herewith, an adjustable lock latch embodied in the present invention is composed of a main body 1, two fastening plates 4 and 4', and two rotary wheels 5 and 6.

The main body 1 is provided at one end thereof with a lock tongue 2, and at one end thereof with a hole 11 and two action rods 3, which are provided with a first projection 31 and a second projection 32.

The fastening plates 4 and 4' are provided respectively with a first position confining hole 41, 41', a second position confining hole 42, 42', and an adjustment hole 43, 43'. The fastening plate 4 also is provided with an elastic element 7.

The first rotary wheel 5 is provided with a through hole 51 and two moving blocks 52 engageable with the first projection 31 of the action rod 3. The second rotary wheel 6 is opposite in location to the first rotary wheel 5 and is provided with a through hole 61 and a semicircular moving block 62 engageable with the second projection 32 of the action rod 3. The rotary wheels 5 and 6 are connected with a handle (shown in phantom lines in FIG. 1).

The moving block 52 of the first rotary wheel 5 is actuated by the handle, which is engaged with the through hole 51 of the first rotary wheel 5, thereby causing the moving block 52 to push the first projection 31 of the first action rod 3 to remain in an unlocked state. In the meantime, the moving block 62 of the second rotary wheel 6 is not in contact with the second projection 32 of the second action rod 3. It must be noted here that the handle is received in the first position confining holes 41 and 41' of the fastening plates 4 and 4', respectively.

The handle also can be received in the second position confining holes 42 and 42' of the fastening plates 4 and 4', respectively, so as to actuate the moving block 62 of the second rotary wheel 6, thereby causing the moving block 62 in motion to push the second projection 32 of the second action rod 3 to remain in an unlocked state. In the meantime, the moving block 52 of the first rotary wheel 5 is disengaged from the first projection 31 of the first action rod 3.

As evident from the original figures, the first rotary wheel 5, the second rotary wheel 6, and the handle will remain co-axial in all operative positions of the lock latch.

Both rotary wheels 5 and 6 are caused to displace horizontally, so as to facilitate the installing of an auxiliary lock in the door.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A lock latch, consisting essentially of:

a main body having a first end and a second end, wherein the first end includes a lock tongue, and the second end includes:

(a) a first action rod having a first projection and a second projection, and (b) a second action rod having a third projection and a fourth projection;

a first fastening plate having a first position confining hole defined therein and a second position confining hole defined therein;

a second fastening plate having a third position confining hole defined therein and a fourth position confining hole defined therein;

a first rotary wheel provided with a first through hole and a first moving block engageable with the first projection of the first action rod and the third projection of the second action rod;

a second rotary wheel provided with a second through hole and a second moving block engageable with the second projection of the first action rod and the fourth projection of the second action rod; and a handle engageable with first and second through holes of the rotary wheels and with either the first and third position confining holes or the second and fourth position confining holes of the fastening plates, so as to rotate the first and second moving blocks of the rotary wheels, wherein the first rotary wheel, the second rotary wheel, and the handle remain co-axial in all operative positions of the lock latch, and wherein the first projection and the third projection extend from the main body toward the first fastening plate, and the second projection and the fourth projection extend from the main body toward the second fastening plate.

2. A lock latch, comprising:

a main body having a first end and a second end, wherein the first end includes a lock tongue, and the second end includes:

(a) a first action rod which includes a first projection along its longitudinal length and a second projection extending from an end of the first action rod located away from the lock tongue, and (b) a second action rod which includes a third projection along its longitudinal length and a fourth projection extending from an end of the second action rod located away from the lock tongue;

a first fastening plate having a first position confining hole defined therein and a second position confining hole defined therein;

a second fastening plate having a third position confining hole defined therein and a fourth position confining hole defined therein;

a first rotary wheel provided with a first through hole and a first moving block engageable with the first projection of the first action rod and the third projection of the second action rod;

a second rotary wheel provided with a second through hole and a second moving block engageable with the second projection of the first action rod and the fourth projection of the second action rod; and a handle engageable with first and second through holes of the rotary wheels and with either the first and third position confining holes or the second and fourth position confining holes of the fastening plates, so as to rotate the first and second moving blocks of the rotary wheels, wherein the first rotary wheel, the second rotary wheel, and the handle remain co-axial in all operative positions of the lock latch, and wherein the first projection and the third projection extend from the main body toward the first fastening plate, and the second projection and the fourth projection extend from the main body toward the second fastening plate.

* * * * *